United States Patent [19]

Hornung

[11] 4,046,097

[45] Sept. 6, 1977

[54] COLLAR FOR REDIRECTING PROPELLER ENERGY

[76] Inventor: Arthur Charles Hornung, 3143 8th St., Boulder, Colo. 80302

[21] Appl. No.: 706,830

[22] Filed: July 19, 1976

[51] Int. Cl.[2] ..... B63H 5/14

[52] U.S. Cl. ..... 115/42; 114/166

[58] Field of Search ..... 115/39, 42, 12 R, 35; 114/150, 151, 148, 166; 244/7 A

[56] References Cited

U.S. PATENT DOCUMENTS

| | | | |
|---|---|---|---|
| 899,359 | 9/1908 | Wadagaki | 115/42 |
| 2,135,162 | 11/1938 | Benson | 115/42 |
| 3,907,219 | 9/1975 | Pharris | 244/7 A |

FOREIGN PATENT DOCUMENTS

| | | | |
|---|---|---|---|
| 637,171 | 4/1928 | France | 115/42 |
| 456,431 | 8/1913 | France | 115/42 |
| 557,728 | 10/1921 | France | 115/42 |
| 1,397,310 | 3/1965 | France | 115/42 |
| 722,842 | 6/1942 | Germany | 115/42 |
| 28,162 | 5/1903 | Switzerland | 115/42 |

*Primary Examiner*—Stephen G. Kunin
*Assistant Examiner*—Stuart M. Goldstein
*Attorney, Agent, or Firm*—Marden S. Gordon

[57] ABSTRACT

A rigid cylindrical collar with an inside diameter slightly larger than the outside diameter of a propeller which is mounted over a propeller and is used singly or in combination with a flexible extension thereto for maximizing the efficiency of propeller blades. The invention is adaptable to watercraft or to aircraft so as to prevent water or air from slipping off the ends of propeller blades so as to redirect energy lost as a result of slipping off the ends of propeller blades in the direction useful for advancing a water or air vehicle. The flexible extension is usable primarily on large watercraft, such as tug boats, ocean vessels and barges, and the like, and could be used with or without a rudder in order to steer a boat in the direction desired.

3 Claims, 4 Drawing Figures

COLLAR FOR REDIRECTING PROPELLER ENERGY

BACKGROUND OF THE INVENTION

1. Field of the Invention

This invention relates to a collar for redirecting propeller energy mounted over propeller blades to prevent water or air from slipping off the ends of propeller blades so as to maximize the effeciency of propeller driven vehicles.

2. Description of the Prior Art

Energy conservation has become a matter of primary concern in today's economy so that many new techniques and product innovations are continually introduced to conserve energy, with many more novel developments still required. Watercraft and aircraft comprise an important sector for energy usage, both for commercial and recreational purposes. Many devices are described for improving the propulsion means of propeller driven crafts, but none are availble for maximizing the utilization of water or air churned by propeller blades. For example, U.S. Pat. No. 3,347,203 issued to Starry Oct. 17, 1967 describes a boat propulsion means which eliminates a propeller and replaces a propeller with a reciprocative piston means enclosed within a shroud extending rearwardly from the rearward end of a boat. U.S. Pat. No. 3,874,320 issued to Wood Apr. 1, 1975 pertains to a boat propulsion apparatus which substitutes a conventional propeller with a lateral undulating device to simulate the motion of a fish while swimming to provide a forward propelling drive. U.S. Pat. No. 3,620,019 issued to Munte Nov. 16, 1971 relates to a jet propulsion drive for watercraft for expulsion of jets or streams of water rearwardly from a boat to provide a jet-like thrust thereto. U.S. Pat. No. 3,565,032 issued to Hertel and Affeld Feb. 23, 1971 illustrates a propulsion arrangement for watercraft wherein propeller blades are attached within a cavity on the underside of a vessel and is designed primarily for passage of a vessel through shallow water. There is, then, an obvious need in the marketplace for a device to maximize the utilization of energy for propeller driven watercraft or aircraft.

SUMMARY OF THE INVENTION

The present invention provides a collar for redirecting propeller energy so as to maximize utilization of water or air on propeller driven watercraft or aircraft.

It is a feature of the present invention to provide a collar for redirecting propeller energy.

A further feature of the present invention provides a collar for redirecting propeller energy which is adaptable to various types of watercraft or aircraft and is reliable and efficient in operation.

Yet still a further feature of the present invention provides a collar for redirecting propeller energy which is of a rugged and durable construction and which, therefore, may be guaranteed by the manufacturer to withstand long and rough usage.

An additional feature of the present invention provides a collar for redirecting propeller energy which is simple in construction and which, therefore, may be produced by a manufacturer at an economical cost so as to encourage widespread usage thereof.

Other features of this invention will be apparent during the course of the following description.

BRIEF DESCRIPTION OF THE DRAWINGS

In the accompanying drawings forming a part of this specification, and in which like reference characters are employed to designate like parts throughout the same.

DESCRIPTION OF THE PREFERRED EMBODIMENT

Figure 1:
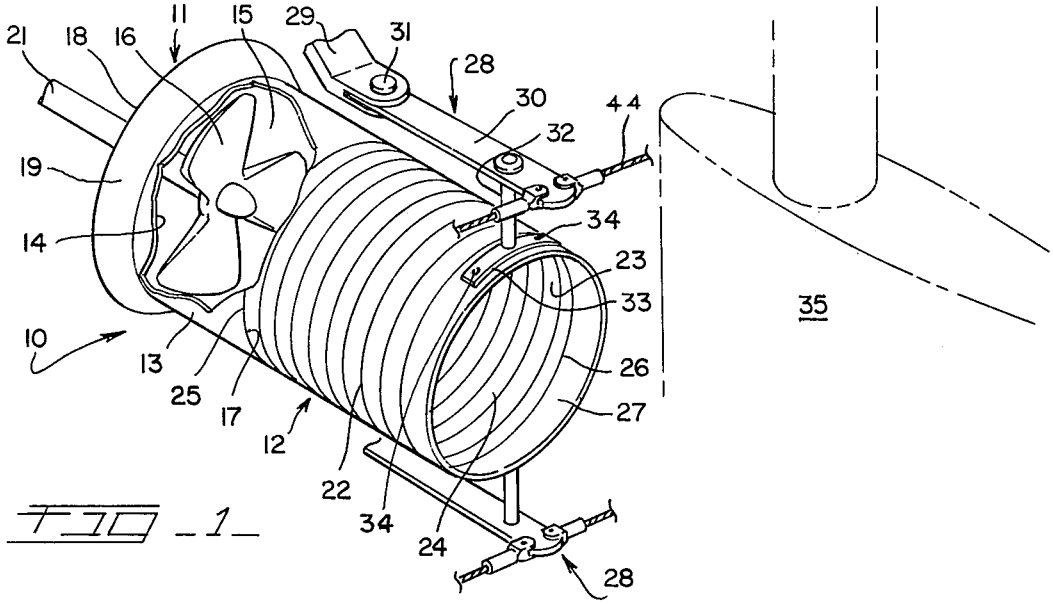
FIG. 1 is a perspective view of the collar for redirecting propeller energy including a rigid collar and flexible extension.

Referring now to the drawings in detail, there is illustrated a preferred form of the collar for redirecting propeller energy constructed in accordance with the principles of the present invention and which is designated generally in its entirety by the reference numeral 10 and which is comprised of a rigid collar 11, a flexible extension 12, and associated configurations and interconnecting components as will be later described.

Figure 3:
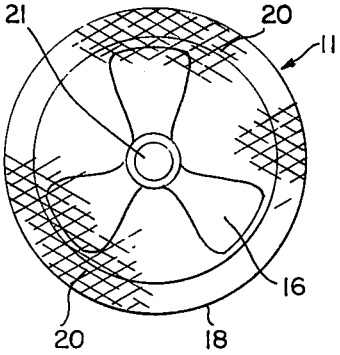
FIG. 3 is a front view of the collar for redirecting propeller energy.
Figure 2:
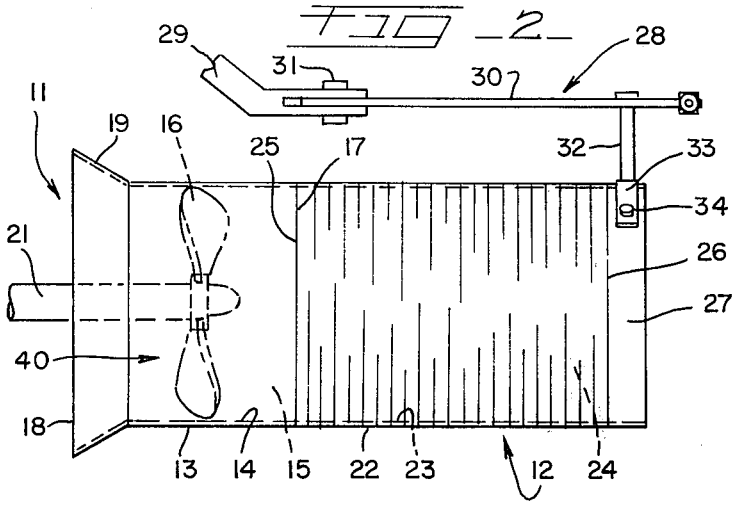
FIG. 2 is a side sectional view of the collar for redirecting propeller energy as illustrated in FIG. 1.

The rigid collar 11 is constructed of a length of durable cylindrical tubing, such as metal or plastic, and consists of an opposed outside surface 13 and inside surface 14 to form a hollow interior 15 along the length of the rigid collar 11 with an inside diameter slightly larger than the outside diameter formed by propeller blades 16, a rear surface 17, and a front surface 18 with a diameter larger than the rear surface 17 formed by the tapered outside surface as shown by the reference numeral 19 to form a larger opening adjacent the front surface 18 than at the rear surface 17. As shown in FIG. 3, the opening into the hollow interior 15 at the front surface 18 is covered with a screen 20 so as to cover the entire opening but provided with a round through hole in the center of the screen 20 to allow passage therethrough of the propeller shaft 21. The rigid collar 11 is assembled to a watercraft or applicable aircraft by securely affixing the front surface 18 to that portion of the water or air vessel from which the propeller blades 16 project with the front surface 18 being secured thereto rigidly in any conventional way but so as to allow free passage of water or air therethrough, such as with special bracketry mounted between the front surface 18 and the vessel (bracketry not shown inasmuch as it is not an essential part of the invention and would tend to obscure the inventive concept described herein).

Figure 4:
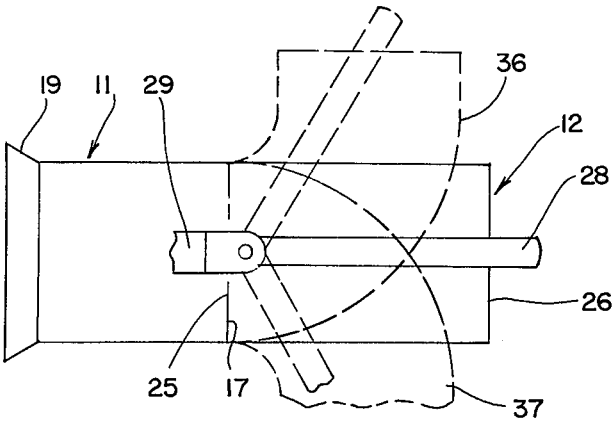
FIG. 4 is a top elevational view of the collar for redirecting propeller energy illustrating the 180° flexibility of the flexible extension.

The flexible extension 12 is constructed of a length of flexible cylindrical material, such as plastic or rubber, and consists of an outside surface 22 and an opposed inside surface 23 to form a hollow interior 24 along the length of the flexible extension 12 with an inside diameter identical to the inside diameter of the hollow interior 15 formed by the inside surface 14 of the rigid collar 11, opposed front and rear surfaces 25 and 26 respectively, with a rigid ring 27 of the same diameter as the flexible extension12 conjoins the rear surface 26. The front surface 25 of the flexible extension 12 conjoins the rear surface 17 of the rigid collar 11 and is affixed thereto in any conventional way, such as by adhesive, external clamping means, or the like, with the ring 27 similarly conjoining the rear surface 26 of the flexible extension 12. A steering or guiding mechanism 28 is provided affixed to the ring 27 and would have to be designed for the particular vehicle to which the collar 10 is assembled, with the particular design of the steering mechanism 28 shown in the drawings being provided for the sake of clarity of illustration and explanation. The steering mechanism 28 as shown in the drawings would consist of a mounting arm 29 secured on one end (not shown) in any conventional way to the particular vehicle, and would be pivotally connected on the other end, as shown in the drawings, to a rotatable arm 30 by means of a pin or rivet 31 and with the rotatable arm 30 being securely affixed in a pivotal manner to the ring 27 by means of an elongated cylindrical rod 32 interconnecting the arm 30 and the ring 27 by means of a semicircular bracket 33 secured to the ring 27 in a conventional way, such as by welding, or, as shown in the drawings, by means of rivets 34, with the rotatable arm 30 further being directionally controlled in any suitable manner, such as by waterproof cables 44 securely affixed to the end of the arm 30 adjacent the ring 27, with the cables 44 being optionally attached to a rudder 35 of a water vessel or with the cables 44 extending to and being operable from the top side of a water vehicle. In any case, as shown in FIG. 4, the flexible extension 12 can be rotated 90° from the axis of the rigid collar 11 as shown by the reference numeral 36 or 90° in the opposite direction, or 180° from the reference numeral 36, as shown by the reference numeral 37.

In operation, the rigid collar 11 would be affixed exclusive of the flexible extension 12 on any aircraft, more particularly on a helicopter, or on small water vessels, such as small pleasure boats or the like. The rigid collar and the flexible extension in combination would be affixed to larger water vessels, such as tug boats, ocean vessels, barges, or the like, with further a single steering mechanism 28 being provided for the smaller of such vessels and, when needed for positive control of the flexible extension 12, two steering mechanisms 28 would be provided. When the propeller blades 16 are started, and when the particular vessel is being urged forwardly, the water or air is pulled through the opening provided at the front surface 18 of the rigid collar 11 as shown by the arrow 40 within the hollow interior 15 and is prevented from slipping off the extreme outside edges of the propeller blades 16 in an outwardly direction but, instead, are forced against the inside surface 14 of the rigid collar 11 so that the entire amount of water or air entering as shown by the arrow 40 are expelled outwardly of the rigid collar 11 beyond the rear surface 17 so as to fully utilize all the water or air in propelling the particular vessel employed. When the flexible extension 12 is utilized, all the water or air is further forced beyond the rear surface 17 of the rigid collar 11 into the hollow interior 24 to be expelled rearwardly of the ring 27 so that, when the ring 27 is rotated by the steering mechanism 28 in the desired direction, the force of the water or air therethrough will turn the vessel in the direction desired. The above procedure is reversed when backing up a water vessel with the water being urged through the collar for redirecting propeller energy 10 in the direction opposite that indicated by the arrow 40. The screen 20 affixed to the front surface 18 of the rigid collar 11 prevents the entrance of foreign particles within the hollow interior 15 or 24 when a vessel is urged forwardly whereas a similar screen (not shown) can be provided to enclose the rear surface 17 of the rigid collar 11 or the ring 27 on the flexible extension 12 to prevent ingress of foreign particles with a vessel being urged rearwardly.

There is thus described a novel collar for redirecting propeller energy which meets all of its stated objectives in maximizing the utilization of water or air energy for impelling propeller driven vehicles, and which overcomes the disadvantages of existing techniques.

It is to be understood that the form of this invention as shown and described is to be taken as a preferred example thereof, and that this invention is not to be limited to the exact arrangement of parts described in the description or illustrated in the drawings as changes thereto in the details thereof pertaining to size, shape and arrangement of parts thereof are envisioned within the scope of the invention without departing from the novel concepts of the invention.

Having thus described the invention, what is claimed is:

1. A collar for redirecting propeller energy from propeller blades of a propeller driving a watercraft to prevent water from slipping off the ends of the propeller blades so as to maximize the efficiency of the propeller, the invention intended to be used with a propeller of a watercraft and comprising, in combination:

a rigid collar, cylindrical in configuration, consisting of opposed outside and inside surfaces to form a hollow interior along its length, a rear surface, and a front surface with a diameter larger than the diameter of said rear surface to form a larger opening at said front surface than at said rear surface;

a screen covering the entire opening formed by said front surface and provided with a round through hole in its center to allow free passage therethrough of a propeller shaft so as to permit the positioning of the propeller blades within the collar hollow interior;

said rigid collar assembled to a watercraft by securely affixing said front surface of said rigid collar to that portion of a watercraft from which the propeller projects, said front surface being secured thereto in a rigid manner in any conventional way so as to allow free passage of water therethrough; and a flexible extension connected to said rigid collar, said flexible extension consisting of opposed outside and inside surfaces to form a hollow interior along the length of said flexible extension with an inside diameter identical to the inside diameter of said hollow interior within said rigid collar, opposed front and rear surfaces with a rigid ring of the same diameter as said flexible extension conjoining said rear surface, wherein further said front surface of the flexible extension conjoins the rear surface of said rigid collar in any conventional way, with said ring similarly conjoining said rear surface of the flexible extension.

2. A collar for redirecting propeller energy as set forth in claim 1 wherein a steering mechanism is affixed to said ring, with said steering mechanism providing a means for rotation of the flexible extension so that the rear surface of said flexible extension and the rigid ring conjoined thereto can be rotated a total of 180° or 90° in any direction fron the axis of said rigid collar.

3. A collar redirecting propeller energy as set forth in claim 2 wherein water churned by the propeller blades is forced into the same plane as is provided by the turning motion of the propeller blades so that water is prevented from slipping off the edges of the propeller.

* * * * *